United States Patent [19]

Konrad

[11] Patent Number: 4,652,429

[45] Date of Patent: Mar. 24, 1987

[54] BIOLOGICAL SAMPLING TUBE

[75] Inventor: Franz Konrad, Regau, Austria

[73] Assignee: C. A. Greiner & Sohne Gesellschaft m.b.H., Kremsmunster, Austria

[21] Appl. No.: 690,148

[22] Filed: Jan. 10, 1985

[30] Foreign Application Priority Data

Jan. 11, 1984 [AT] Austria ..... 61/84

[51] Int. Cl.[4] ..... B01L 3/00

[52] U.S. Cl. ..... 422/102; 215/249

[58] Field of Search ..... 422/99, 102; 215/247, 215/249, 306, 319, 327; 128/764

[56] References Cited

U.S. PATENT DOCUMENTS

| | | | |
|---|---|---|---|
| 3,607,098 | 9/1971 | Strande | 422/102 |
| 4,089,432 | 5/1978 | Crankshaw et al. | 215/249 |
| 4,205,754 | 6/1980 | Nielson et al. | 215/249 |
| 4,278,437 | 7/1981 | Haggar | 422/102 |
| 4,295,974 | 10/1981 | Cornell | 422/102 |
| 4,342,724 | 8/1982 | Narra | 422/102 |
| 4,517,851 | 5/1985 | Tice | 422/102 |
| 4,546,085 | 10/1985 | Johansson et al. | 422/102 |

FOREIGN PATENT DOCUMENTS

| | | |
|---|---|---|
| 368389 | 10/1982 | Austria . |
| 2243593 | 3/1973 | Fed. Rep. of Germany . |
| 2908817 | 9/1980 | Fed. Rep. of Germany . |

*Primary Examiner*—Kenneth M. Schor
*Assistant Examiner*—Michael K. Boyer
*Attorney, Agent, or Firm*—Karl F. Ross; Herbert Dubno

[57] ABSTRACT

A blood sampling tube preferably of glass is formed with a hermetic closure which is applied by press fitting and can be pulled off the tube. The closure has an annular cap in which the needle-pierceable membrane is secured and whose inner and outer walls flank the walls of the tube to the mouth of the cap, an annular portion of the membrane being compressed between the inner cap wall and the inner surface of the tube.

12 Claims, 1 Drawing Figure

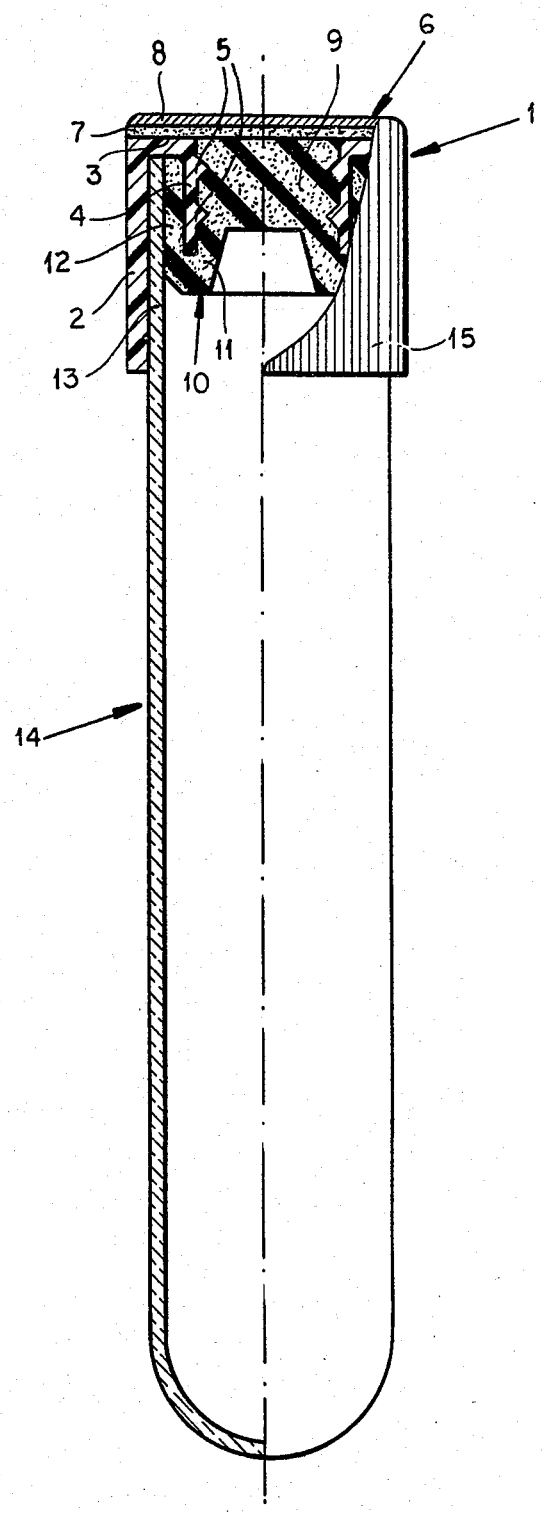
8
5
9
6
1
7
3
4
12
2
13
10
11
15
14

BIOLOGICAL SAMPLING TUBE

FIELD OF THE INVENTION

My present invention relates to a biological sampling tube and, more particularly, to a blood sampling tube or a specimen holder of the type which has a closure which can be pierced by a needle to receive a biological specimen, e.g. a blood specimen, withdrawn from a subject or patient.

BACKGROUND OF THE INVENTION

In recent years, as a time-saving and a handling-reducing measure, blood sampling devices have been provided which make use of a double-ended needle. One end of this needle can be inserted into a vein and a previously evacuated and sterile displaceable sampling tube can be connected to the opposite end of the needle to receive the blood specimen.

Such specimen tubes can have a self-sealing closure at the mouth of the tube which can be pierced by the second end of the needle and communication can thereby be established between the evacuated interior of the sampling tube and the needle.

The closure can have a sealing membrane of an elastomeric material, e.g. a silicone rubber, which can be covered in turn by a flat, uniform thickness foil, e.g. of aluminum, which can be formed with a heat-sealable layer on its side turned toward the interior of the specimen tube.

A vacuum blood sampling tube of this type is described in German patent document—Open Application No. DE-OS 29 08 817. In that system, the closure is formed with a cap which is screwed onto the tube and has an opening spanned by the membrane through which a needle end can be inserted.

One problem with this specimen tube construction is that the mouth of the tube and the closure must be formed with mating screw threads and, of course, care must be taken upon threadedly interconnecting the cap and the tube that an effective seal is created. This can be a time-consuming process which cannot be readily carried out in an automated manner.

Access to the contents of the tube also requires unscrewing of the cap which is also a time-consuming process at the time of analysis and requires careful handling.

Perhaps a more significant disadvantage, however, is the fact that it is not possible to tell with such screw cap closures whether the interior of the sampling tube or its contents has been tampered with. Finally, when analysis is not to be carried out immediately, i.e. the tubes are to be stored for a comparatively long time, or the tubes are stored for a long time before they are used, problems are encountered because the cap materials are microporous and, indeed, vacuum may be lost so that the suction upon use may be insufficient.

In German patent document—Open Application No. DE-OS 22 43 593, a similar sampling tube is provided in which the closure is a metal cap which is clenched onto the tube end, much as a conventional bottle cap is applied. At its central portion, a circular crown part is provided and outwardly but connected thereto, the cap has an annular downwardly extending sleeve of inverted U-profile, the latter terminating in an upwardly bent edge. The central portion of the circular crown part is provided of reduced thickness so that it can be readily penetrated by the hollow needle. At least the inner surface of the metal cap, preferably its entire lower surface, is covered with a thin protective layer of polyvinyl chloride or some other vinyl composition to prevent the penetration of impurities into the interior of the tube. The seal is fixed to the outer surface of the metal cap and the mounting of the cap with its U-profile on the tube end is effected by means of hot melt materials such as polyamides to provide an adhesive bond between the abutting surfaces of the sleeve and the outer surface of the tube end.

With this arrangement, a bottle opener of conventional design may be used to remove the metal cap.

This conventional closure arrangement is not only relatively complex but, because it is composed of numerous parts, also suffers from lack of reliability and the need for relatively complex manipulation operations.

An improvement on the latter closure is described in Austrian Pat. No. 368 389. Here the closure comprises a foil of preferably uniform wall thickness and which is provided on one side with a heat-sealable layer forming a hermetic seal between the foil and the end faces of the tube, the foil being separated from the interior of the tube by this continuous heat-sealing layer.

In general, the use of heat-sealing foils, while satisfactory at least to a limited extent with blood sampling tubes, composed of synthetic resin materials, has not been fully satisfactory with glass tubes.

OBJECTS OF THE INVENTION

It is, therefore, the principal object of the present invention to provide high-vacuum blood sampling tubes for use with vacuum blood sampling devices and in which the closures can maintain especially high vacuums for long periods.

Another object of this invention is to provide an improved closure for a glass sampling tube which can bridge the especially wide tolerances in the manufacture of such tubes without detrimentally affecting reliability.

Yet another object of the invention is to provide an improved glass sampling tube or closure therefor, which obviates the drawbacks of earlier specimen tubes.

SUMMARY OF THE INVENTION

These objects and others which will become apparent hereinafter are attained, in accordance with the present invention, in a glass sampling tube whose closure comprises a heat-sealable layer which is bonded to the double-wall cap having an inner and outer wall straddling the edge of the sampling tube at the mouth thereof, the outer wall lying along the outer surface of the tube, the inner wall being spaced from the inner surface of the tube and the membrane which fills the cap within the annular inner wall, having an annular apron extending sealingly into the gap between the inner wall of the cap and the inner surface of the tube. The inner and outer walls are connected by a web of the cap lying in a plane perpendicular to the axis of the tube and extending across the edge of the mouth thereof to provide the seat to which the foil, via the heat-sealable layer, is thermally bonded to span the mouth of the tube.

The cap is provided with a press fit on the mouth of the tube and because a layer of the membrane is comprised between the inner wall of the cap and the inner surface of the tube, a vacuum-tight seal is maintained.

In other words, the mouth of the tube is enclosed between the walls of the cap and an outer layer of the sealing membrane which is compressed against the tube wall so that, especially when the tube is under vacuum, a completely effective seal is provided.

The foil is advantageously heat-sealed to the membrane body which is disposed in the space surrounded by the annular inner wall of the cap so that the outer surface of this membrane, which can be composed of any silicone rubber, lies flush with the aforementioned web.

The rigidity of the membrane for penetration by the needle is enhanced by the heat-sealing of the membrane directly to the foil in this manner.

I have found that is advantageous to form the outer wall of the cap of a greater length than the inner wall and, indeed, of a greater axial length than the axial length of the membrane body. This results in an enhanced mechanical engagement of the cap with the tube. The longer outer wall can be milled, grooved or otherwise provided with antislip formations enabling the cap to be gripped so that it may be pulled from the tube without unscrewing.

To increase the interconnection between the elastomeric membrane and the cap, the inner wall of the cap is formed along its inwardly facing surface with formations engaging in the plug-like body of the membrane, e.g. in the form of a rib or protuberances. Preferably annular ribs of triangular or wedge-shape cross sections are provided.

The cap is completely separated from the interior of the tube by the diaphragm or membrane so that leakage by diffusion through the cap or resulting from any microporosity thereof is precluded.

BRIEF DESCRIPTION OF THE DRAWING

The above and other objects, features and advantages of the present invention will become more readily apparent from the accompanying drawing in which the sole FIGURE is an elevational view of the sampling tube of the invention, partially broken away to show the closure cap in a cross section.

SPECIFIC DESCRIPTION

The blood specimen tube 14 shown in the drawing, which is composed of glass, can be used in a vacuum blood sampling device of the type described in the aforementioned German patent documents and, at its mouth, is provided with a cap 1 of synthetic resin material, e.g. an injection-molded synthetic resin.

The cap 1 has a generally cylindrical form and comprises an outer wall 2, an end wall or web 3, and an inner wall 4, the outer and inner walls 2 and 4 being annular and straddling the end of the tube 14 which can be received with substantial clearance at least between the inner wall 4 and the inner surface of this tube so that irregularities conventional in the manufacture of glass tubes can be accommodated.

The inner wall 4 is formed along its inner surface with a pair of axially spaced annular ribs 5 which are circumferentially continuous and which are of triangular cross section or wedge shape.

The end face 3 of the cap is flush with the end face of a plug-shaped membrane 9 and an outer closure element 6 in the form of a disk can be heat-sealed to the end wall 3 and the membrane 9 by a heat sealing layer 7 previously applied to the disk. The disk may be an aluminum foil 8 of uniform wall thickness. Preferably the thickness of the aluminum foil disk is 0.3 mm. Via the layer 7 and the heat sealing, the member 6 is fixed to the end wall 3 and to the membrane 9, thereby stiffening the latter for penetration by a needle.

The membrane 9 can have a thickness of 2 to 4 mm in its central region within the wall 4 and can be comprised of an elastomeric material such as a foam rubber, although it preferably is a silicone rubber.

The membrane 9 forms part of a membrane body or cap 10 which has an annular apron 11 extending downward and outward to a location below the inner wall 4 of the cap.

An upwardly extending outer annular layer 12 of this elastomer is received under compression within the space between the inner wall 4 and the inner surface of tube 14. The free end of the mouth of the tube 14 is thus sealingly held in the space between the outer surface of the layer 12 and the inner surface of the outer wall 2. Since member 10 is elastically yieldable, an especially effective seal is obtained when the assembly is forced on the tube 14 with a press fit and the tube is evacuated. The membrane 9 can be heat-sealed or vulcanized to the cap 1 if desired and the outer wall 2 of the cap can be grooved or milled at 15 to facilitate gripping.

The handling and use of this tube corresponds to that of the tube described in German Open Application No. DE-OS 2 908 817.

The needle pierces the foil 8 and the membrane 9 to deliver the blood specimen to the tube 14. In the analysis laboratory, the cap 1 can be gripped and simply pulled off the tube 14.

Modifications of the specific construction illustrated and described are possible within the scope of the invention. For example, the tube 14 can also be composed of a plastic material and the foil 8 can also be composed of a plastic or synthetic resin material.

In place of the annular ribs 5, other formations can be used which can be individual, i.e. spaced apart around the inner periphery of the inner wall 4 and can have different configurations, e.g. ball or roll shapes, hemispherical shapes, pyramidal shapes or even round-rib shapes.

The cap 1 can be composed of thermoplastic or thermosealing synthetic resins of which the most preferable are high-impact polystyrene, polypropylene, thermoplastic polyesters or polyamides and polymethylmethacrylate. The membrane 10 can be formed by injection molding directly in the cap 1.

Finally, the sampling tube need not be used exclusively for blood sampling but can also be employed for the sampling of other body fluids or for infusion or for similar purposes.

I claim:

1. A tube assembly for biological materials, the assembly comprising:

a tube having a substantially cylindrical mouth and extending along an axis; and a needle-pierceable closure press fitted on and hermetically sealing said tube at said mouth, said closure comprising a cap fitted over said mouth and consisting of a cylindrical and annularly continuous outer wall lying radially against an outer surface of said tube at said mouth, an annular end wall extending radially inward from said outer wall at said mouth, and a cylindrical and annularly continuous inner wall connected to said end wall and extending axially into said tube at said mouth but spaced from an inner surface of said tube at said mouth, said inner wall being parallel to said outer wall and perpendicular to said end wall, a needle-pierceable and elastomeric membrane received within said cap and connected thereto, said membrane being unitarily formed with an annularly continuous, cylindrical, and elastically compressible portion extending beneath said end wall and within the space between said inner wall and said inner surface, the portion being compressed radially between the inner wall and the inner surface and thereby forming a seal between said cap and said tube, and a plug portion surrounded by said inner wall, and being unitary with said compressible portion, and spanning said cap, flush with said end wall, and a seal member of uniform thickness heat-sealed to said end wall across said cap and said membrane.

2. The tube assembly defined in claim 1 wherein said seal member is heat-sealed also to said membrane within said cap.

3. The tube assembly defined in claim 1 wherein said outer wall is of greater axial length than said membrane.

4. The tube assembly defined in claim 3 wherein said inner wall is provided with formations penetrating into said membrane.

5. The tube assembly defined in claim 4 wherein said formations are provided on an inwardly facing surface of said inner wall.

6. The tube assembly defined in claim 5 wherein said formations are annular ribs.

7. The tube assembly defined in claim 6 wherein said annular ribs are of triangular cross section.

8. The tube assembly defined in claim 7 wherein said seal member is composed of aluminum foil provided with a heat-sealing layer.

9. The tube assembly defined in claim 8 wherein said cap is unitarily molded from a synthetic resin.

10. The tube assembly defined in claim 9 wherein said membrane is composed of a silicone rubber.

11. The tube assembly defined in claim 10 wherein said seal member is flush with said outer wall.

12. The tube assembly defined in claim 11 wherein said tube is a glass tube.

* * * * *